US006223818B1

(12) United States Patent
Hrupp

(10) Patent No.: US 6,223,818 B1
(45) Date of Patent: May 1, 2001

(54) PERFORATING GUN BRAKE

(76) Inventor: Joe Hrupp, 49 Diamond Ave., Spruce Grove, Alberta (CA), T7X 3B5

( * ) Notice: Subject to any disclaimer, the term of this patent is extended or adjusted under 35 U.S.C. 154(b) by 0 days.

(21) Appl. No.: 09/110,535

(22) Filed: Jul. 6, 1998

(30) Foreign Application Priority Data

Jan. 16, 1998 (CA) ..... 2227354

(51) Int. Cl.[7] ..... E21B 29/00; E21B 29/02
(52) U.S. Cl. ..... 166/63; 166/55
(58) Field of Search ..... 166/55, 63; 102/312, 102/313

(56) References Cited

U.S. PATENT DOCUMENTS

| | | | | |
|---|---|---|---|---|
| 2,679,899 | * | 6/1954 | Osborn | 175/4.5 |
| 2,965,031 | | 12/1960 | Johns | 175/4.51 |
| 4,158,389 | | 6/1979 | Chammas et al. | 166/297 |
| 4,574,892 | | 3/1986 | Grigar et al. | 175/4.51 |
| 4,598,769 | | 7/1986 | Robertson | 166/55 |
| 4,823,876 | * | 4/1989 | Mohaupt | 166/299 |
| 4,852,647 | * | 8/1989 | Mohaupt | 166/63 |
| 4,889,187 | | 12/1989 | Terrell et al. | 166/298 |
| 4,917,187 | | 4/1990 | Burns et al. | 166/297 |
| 4,971,146 | | 11/1990 | Terrell | 166/55 |
| 5,700,968 | | 12/1997 | Blimke | 102/312 |

* cited by examiner

*Primary Examiner*—David Bagnell
*Assistant Examiner*—Jennifer Dougherty
(74) *Attorney, Agent, or Firm*—Zarley, McKee, Thomte, Voorhees & Sease

(57) ABSTRACT

A brake mechanism for use with a perforating gun to prevent the explosive forces from causing recoil comprising a cylindrical body with openings permitting brake plugs to engage the well casing in response to pressure against an axially moving piston driven by the explosive force of the perforating gun and having a tapered side wall to drive the plugs against the casing. A bias spring disengages the axial piston and a retractive spring withdraws the plugs from engagement.

7 Claims, 3 Drawing Sheets

PERFORATING GUN BRAKE

BACKGROUND

This invention relates to improvements in the design for downhole equipment used in the completion of petroleum wells. More particularly, it relates to an improved design for a device used to create perforations in the well casing through which oil and gas are extracted from a reservoir.

In most conventional oil and gas wells the well is completed by cementing a string of steel casing in the well across the production zone near the bottom of the hole. Once this casing is in place production of the oil or gas is permitted by perforating holes in the casing opposite the production zone using shaped explosive charges known as a perforating gun.

Perforating guns for this purpose are normally lowered down the hole inside the casing on a cable (with an electrical connection) until the explosive charges are opposite the production zone. The electrical wires are energized to ignite the charges which pierce holes in the casing (and any surrounding cement) into the rock formation and allow the flow of the oil or gas into the well. These techniques are old and well known in the industry.

However, a problem often arises that with the explosion of the perforating charges the gun and attached cables and wires are often explosively driven up the well casing where they become tangled and jammed in the casing bore so that they cannot be removed by merely hoisting the cable. This often requires an expensive and time-consuming "fishing" operation to release the entanglement and retrieve the debris.

SUMMARY

It is therefore the purpose of this invention to provide a mechanism which may be attached to and lowered with a perforating gun and will effectively prevent the upward recoil of the equipment and the above-mentioned problems associated therewith.

More specifically, it is the purpose of this invention to provide a tool which may be attached to a perforating gun and will serve to grip the inner walls of the casing with enough resistance to create a breaking effect and prevent the upward recoil of the equipment and suspending cables immediately after the firing of the perforating gun.

It is also the purpose of this invention to provide a simple and relatively inexpensive mechanism which will automatically activate when the gun is fired and released shortly thereafter without elaborate control mechanism and without creating further problems in the retrieval of this equipment from the hole after the perforating operation is completed.

These objects and other advantages are achieved by the present invention which provides a brake mechanism for use in association with a petroleum well perforating gun and comprises a body with an outer shell having openings therein, brake plugs mounted in said openings to engage the casing of said well, a piston movable within said body and having a tapered portion designed to engage said plugs and move said plugs in the radial direction, orifice means to communicate pressure from said perforating gun to said piston to activate said plugs when the perforating gun is fired. The invention also has spring bias means to disengage said piston from said brake plugs when explosive pressure is not applied. The brake plugs may be released from engagement by a retractive spring means.

DESCRIPTION

The invention may be better understood by a detailed description of one embodiment thereof with reference to the attached drawings in which.

Figure 1:
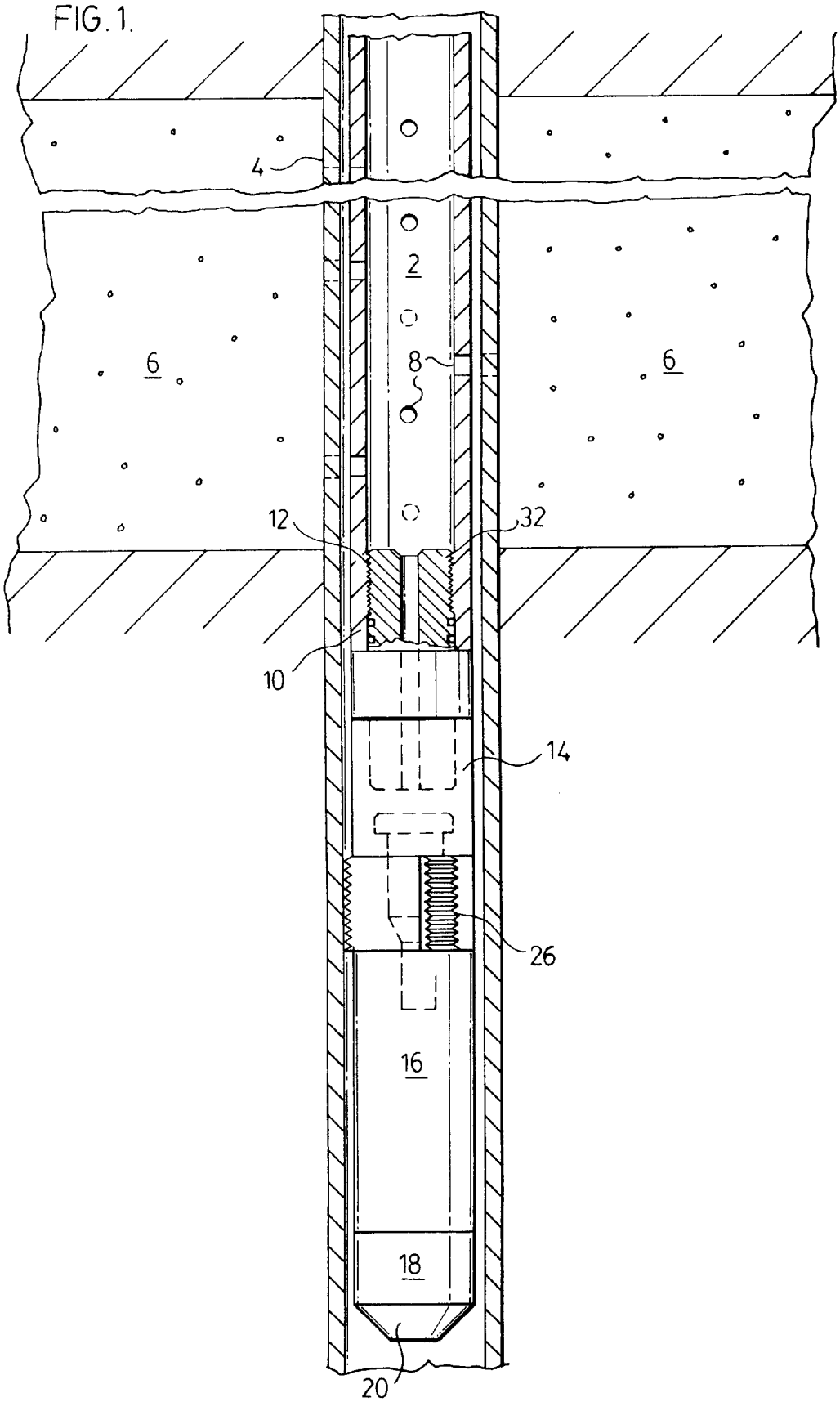
FIG. 1 is a schematic illustration of a perforating gun with an attached brake of the present invention positioned within an oil well casing to be perforated.

FIG. 1 illustrates a perforating gun 2 which is suspended downhole inside a steel casing 4 opposite a petroleum production zone 6 by means of a suspending cable (not shown) above.

The cylindrical recesses 8 in the perforating gun represent locations where shaped charges are attached which are designed to explode with a directional force sufficient to perforate the steel casing and penetrate into the production zone from which oil or gas is to be extracted. These charges are usually ignited by means of a wire connection which is lowered with the gun and is also not shown.

At the bottom of the perforating gun is a connecting sub 10 which is threadably fastened to the bottom of the perforating gun by threads at 12 and has threadably attached at its lower end by threads 14 a brake mechanism 16 which is designed in accordance with the present invention. A bull plug 18 having a solid tapered nose 20 is attached to the bottom to facilitate the downward travel of the equipment as it enters the well.

Figure 2:
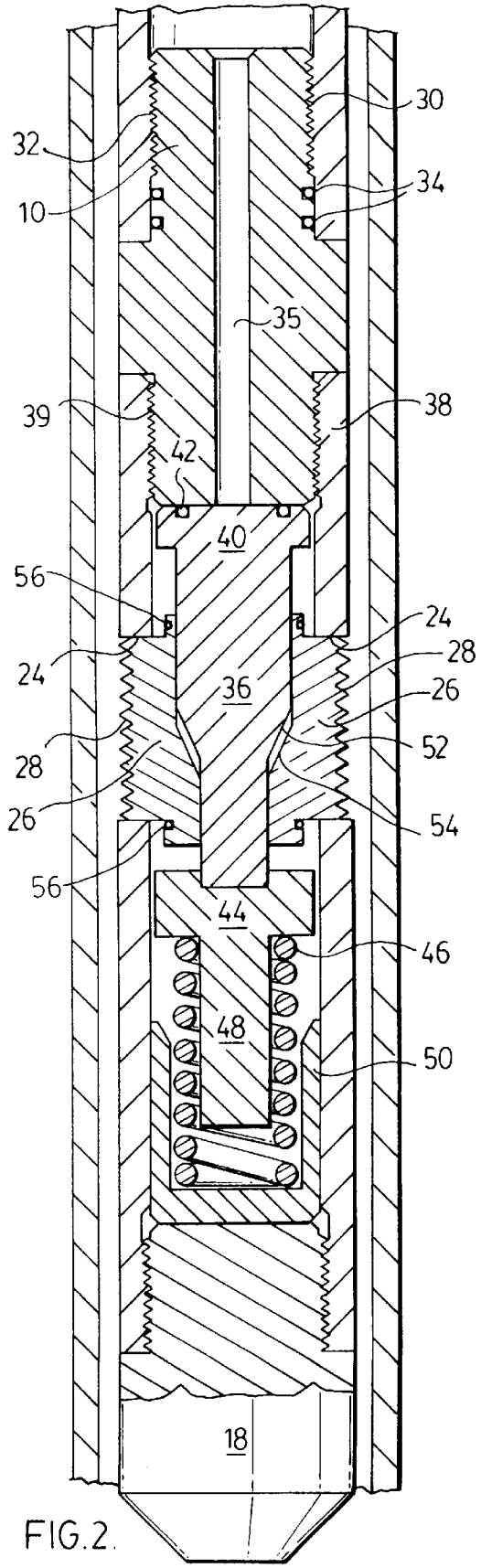
FIG. 2 is a vertical cross-section of the brake mechanism illustrated in FIG. 1.
Figure 3:
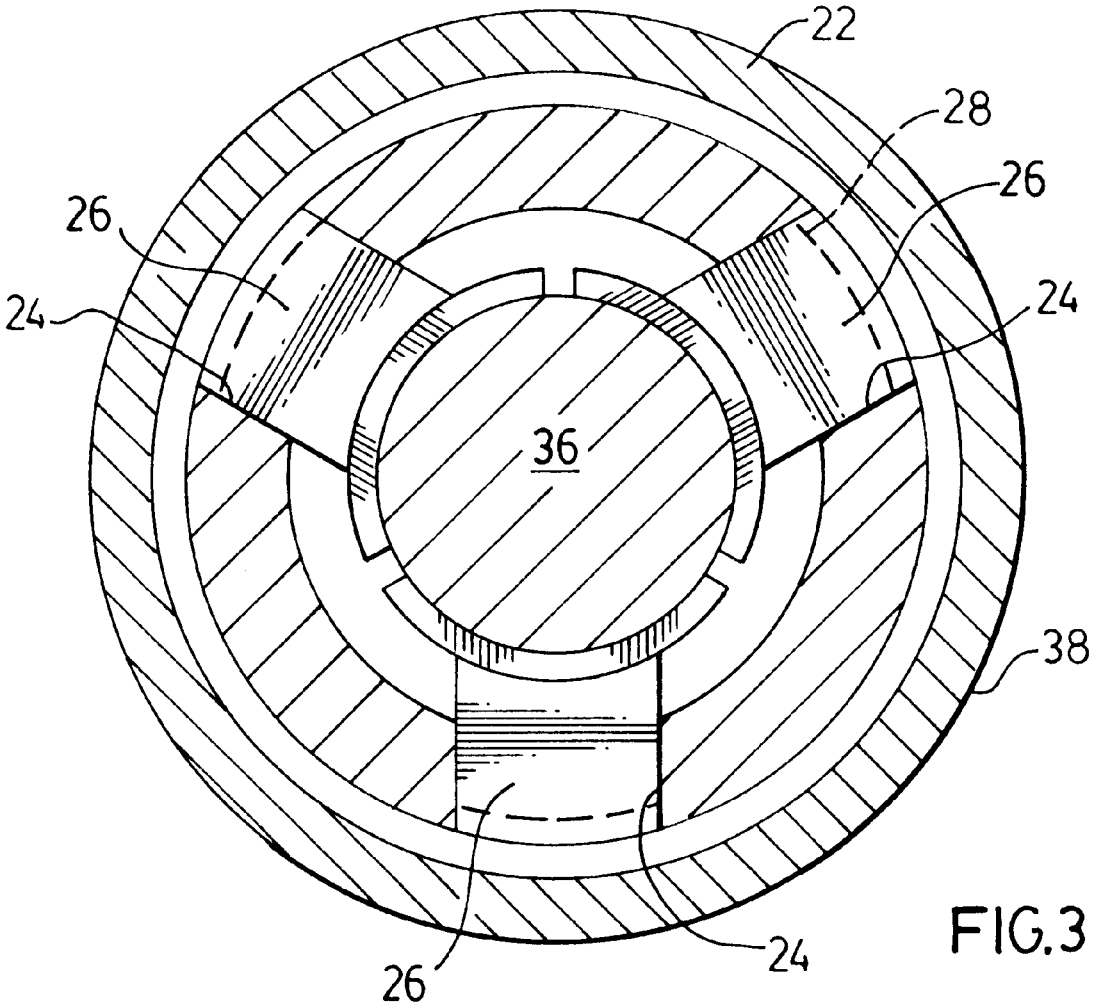
FIG. 3 is a horizontal cross-section through the apparatus in FIG. 2.

In FIG. 3 the cylindrical outer barrel 22 of the body of the brake mechanism 16 is illustrated with three circumferentially spaced window openings 24, each containing a rectangular plug 26 having an outer surface 28 with a curvature similar to the outer barrel 22 and having a set of serrated teeth best seen in the illustration of FIG. 2.

The serrated surface 28 of the plugs 26 are designed to engage the inner wall of the casing 4 to prevent the mechanism from excessive movement after the perforation gun has fired and they are operated by means of the mechanism best illustrated in the cross-sectional view of FIG. 2.

As shown in FIG. 2, the connecting sub 10 has male threads 30 which connect to corresponding female threads 32 at the lower end of the perforating gun and seal rings 34 to create a fluid tight connection between the inner bore and the outer surfaces of the equipment. A central orifice 35 runs from the upper end to the lower end of the connecting sub. The brake body 38 is connected to the lower end of the connecting sub by means of threads 39 and has at its lower end the bull plug 18 as illustrated in FIG. 1.

As previously mentioned in connection with FIG. 3, the barrel 22 of the brake mechanism has windows 24 containing plugs 26 with serrated teeth 28 designed to engage the inner surface of the casing when activated.

To activate the plugs 26 a tapered piston 36 is provided with an upper end 40 which is exposed to the orifice 35. This connection is sealed in the inactivated position illustrated by means of the seals 42 in the upper surface 40 of the piston 36.

Beneath the plugs 26 the lower end of the piston 36 is supported by a disc 44 which is urged upwards by a compression spring 46 mounted between the lower shaft 48 of the disc 44 and the cup 50 mounted at the bottom of the brake bore and held in place by the bull plug 18.

From the foregoing illustrations, it will be readily apparent that when the perforating charges 8 are fired the explosive pressures will travel down the inner orifice 35 of the connecting sub 10 to the upper surface 40 of the piston 36 which will then be driven downward against the disc 44 and against the compressive forces of the spring 46 until the tapered surface 52 of the piston 36 engages the corresponding tapered surfaces 54 of the plugs 26 at which point it will have the effect of driving the plugs 26 radially outward until they engage the inner surface of the casing 4. This will prevent the downhole equipment, including the perforating gun, the connecting sub, the brake mechanism, and the suspending cable from being driven up the hole.

This engagement will take place immediately upon the firing of the perforating gun in response to the explosive forces without any separate activation.

It is possible, if desired, to dimension the brake device so that the space between the bottom of the lower shaft 48 and the bottom of the cup 50 is dimensioned to provide a limited travel of the piston 36 and therefore will limit the amount of outward movement of the brake plugs 26 according to the internal dimension of the casing.

As soon as the explosive forces have dissipated, the compression spring 46 will force the tapered piston 36 upwards and will release the plug 26 from engagement with the wall of the casing so that the entire string of equipment can be readily retrieved from the hole by the suspending cable.

Once the tapered piston 36 has moved back to its inactive upper position as illustrated, the plugs 26 can be retracted by means of a circumferential retractive spring as illustrated at 56 in FIG. 2.

Thus, by means of the relatively simple, inexpensive, rugged and uncomplicated equipment illustrated, the problems referred to above can be eliminated by a mechanism which activates automatically and disengages automatically. Furthermore, the mechanism is, except for the outer surface of the plugs 26, contained within the interior of the barrel of the brake mechanism where the moving parts are protected from damage and isolated from rock cuttings and debris which might interfere with their operation.

Thus, under normal circumstances, the brake mechanism may be used over and over without repair or reconditioning.

It will, of course, be realized that numerous modifications and variations of the illustrated embodiment may be employed without departing from the inventive concept herein.

What is claimed is:

1. A brake mechanism for use in association with a petroleum well perforating gun comprising:

a cylindrical body having an outer shell with openings therein;

brake plugs mounted to travel through said openings and adapted to engage the well casing;

piston means mounted within the outer shell and movable axially in response to explosive pressure from said perforating gun and having tapered side wall means adapted to engage said brake plugs so that explosive pressure from said perforating gun moves the piston axially in a direction to engage the plugs and force them radially outward against the well casing.

2. The brake mechanism as claimed in claim 1 in which spring means bias the said piston against engagement with said brake plugs in the absence of explosive pressure from said perforating gun.

3. Apparatus as claimed in claim 2 in which said brake plugs are retracted to disengage by a circumferential spring.

4. Apparatus as claimed in claim 2 in which explosive pressure from said perforating gun is communicated to said piston by means of a connecting sub having a central orifice running axially from the upper end to the lower end thereof.

5. Apparatus as claimed in claim 1 in which said brake plugs are retracted to disengage by a circumferential spring.

6. Apparatus as claimed in claim 3 in which explosive pressure from said perforating gun is communicated to said piston by means of a connecting sub having a central orifice running axially from the upper end to the lower end thereof.

7. Apparatus as claimed in claim 1 in which explosive pressure from said perforating gun is communicated to said piston by means of a connecting sub having a central orifice running axially from the upper end to the lower end thereof.

* * * * *